US006247800B1

(12) United States Patent
Mutoh

(10) Patent No.: US 6,247,800 B1
(45) Date of Patent: Jun. 19, 2001

(54) INK JET RECORDING APPARATUS WITH INK DROP REGISTRATION CONTROL

(75) Inventor: Masayuki Mutoh, Machida (JP)

(73) Assignee: Silver Seiko Ltd., Tokyo (JP)

( * ) Notice: Subject to any disclaimer, the term of this patent is extended or adjusted under 35 U.S.C. 154(b) by 0 days.

(21) Appl. No.: 08/961,987

(22) Filed: Oct. 31, 1997

(30) Foreign Application Priority Data

Nov. 18, 1996 (JP) ..... 8-322271

(51) Int. Cl.[7] ..... B41J 2/025
(52) U.S. Cl. ..... 347/74; 347/10
(58) Field of Search ..... 347/74–78, 80, 347/10

(56) References Cited

U.S. PATENT DOCUMENTS

| | | | | |
|---|---|---|---|---|
| 4,015,267 | | 3/1977 | Kasubuchi et al. | 347/74 |
| 4,620,196 | | 10/1986 | Hertz | 347/74 |
| 4,851,860 | * | 7/1989 | Mutoh | 347/75 |
| 5,325,112 | | 6/1994 | Mutoh | 347/74 |
| 5,381,170 | * | 1/1995 | Mutoh | 347/74 |
| 5,402,164 | | 3/1995 | Mutoh | 347/74 |
| 5,450,111 | * | 9/1995 | Mutoh | 347/78 |
| 5,583,552 | | 12/1996 | Mutoh | 347/74 |
| 5,724,152 | * | 3/1998 | Hayashi et al. | 358/296 |
| 6,046,822 | * | 4/2000 | Wen et al. | 358/1.9 |

FOREIGN PATENT DOCUMENTS

| | | |
|---|---|---|
| 62-225363 | 10/1987 | (JP) . |
| 5-246034 | 9/1993 | (JP) . |
| 7-290704 | 11/1997 | (JP) . |

OTHER PUBLICATIONS

Patent Abstracts of Japan vol. 017, No. 709 (M–1535) Dec. 24, 1993 & JP 05 246034 A (S R Technos KK) Sep. 24, 1993.

Patent Abstracts of Japan vol. 096, No. 003 Mar. 29, 1996 & JP 07 290704 A (Silver Seiko Ltd) Nov. 7, 1995.

Patent Abstracts of Japan vol. 007, No. 283 (M–263) Dec. 16, 1983 & JP 58 158265 A (Nippon Denshin Denwa) Sep. 20, 1983.

Patent Abstracts of Japan vol. 018, No. 220 (M–1595) Apr. 20, 1994 & JP 06 015827 A (Hitachi Ltd) Jan. 25, 1994.

* cited by examiner

*Primary Examiner*—N. Le
*Assistant Examiner*—Shih-Wen Hsieh
(74) *Attorney, Agent, or Firm*—Wallace G. Walter

(57) ABSTRACT

An ink jet recording apparatus with ink drop registration control adjusts the timing of the ink drop or drops that form each pixel to compensate for time-of-flight differences that are a function of the number of ink drops that form a pixel and as a function of the ink drops that constitute one or more immediately preceding pixels. A pixel buffer stores successive pixel data in a first-in first-out (FIFO) manner so that the timing of the ink drop for a current pixel can be adjusted, in part, as a function of the number of ink drops of at least one next successive pixel.

10 Claims, 10 Drawing Sheets

RM
DR
SE
op
fE
6
8
7
5
4
1
3
2
φc*
HVS
HIGH VOLTAGE SWITCH
Sc*
CD
VIBRATING ELEMENT DRIVER
fd
PWM
PULSE WIDTH MODULATOR
fE*
OSC
OSCILLATOR
PB
PIXEL BUFFER
fE
DPG
DELAY PULSE GENERATOR
Dp
LB
LINE BUFFER

INK JET RECORDING APPARATUS WITH INK DROP REGISTRATION CONTROL

BACKGROUND OF THE INVENTION

1. Field of the Invention

This invention relates to a continuous jet type ink jet recording apparatus, and more particularly to a technique for controlling the recording dot position of a continuous jet type ink jet recording apparatus accurately to improve the picture quality.

2. Description of the Related Art

An apparatus wherein the number of ink drops to be hit upon a single pixel is variably controlled using an ink jet recording technique of the continuous jet type to vary the recording dot diameter or dot size to represent a concentration is already known and disclosed, for example, in U.S. Pat. No. 4,620,196 or Japanese Patent Laid-Open Application No. Showa 62-225363.

Referring to FIG. 10, there is shown in diagrammatic view an exemplary one of a conventional continuous jet type ink jet recording apparatus of the rotary drum type. The continuous jet type ink jet recording recording apparatus shown includes, as principal components thereof, a nozzle 1 to which ink under pressure is supplied, an ink electrode 2 for connecting the potential of the ink in the nozzle 1 to the ground potential level, a vibrating element 3 mounted on the nozzle 1, an oscillator OSC for generating a disintegrating frequency signal $f_d$ having a fixed disintegrating frequency $f_d$ (in the following description, a same reference character is applied to both of a signal and a frequency), a vibrating element driver CD for amplifying the disintegrating frequency signal $f_d$ from the oscillator OSC to drive the vibrating element 3 and synchronously disintegrate a jet of the ink, a control electrode 4 having a circular opening or a slit-like opening coaxial with the nozzle 1 for receiving a charge control signal $\phi_C$ to control charging of the ink jet in accordance with pixel data (pixel density data) $D_P$, a grounding electrode 5 disposed in front of the control electrode 4 and grounded itself, a knife edge 6 mounted on the grounding electrode 5, a deflecting high voltage dc power supply (hereinafter referred to simply as deflecting power supply) 7, a deflecting electrode 8 connected to the deflecting power supply 7 for cooperating with the grounding electrode 5 to produce therebetween an intense electric field perpendicular to an ink jet flying axis to deflect a charged ink drop to the grounding electrode 5 side, a line buffer LB for storing therein pixel data $D_P$ for one rotation of a rotary drum DR for generating the charge control signal $\phi_C$, a pulse width modulator PWM for modulating pixel data $D_P$ read out from the line buffer LB in synchronism with an encoder clock (dot recording clock) signal $f_E$ from a shaft encoder SE coupled to a shaft of the rotary drum DR into a width of a pulse in synchronism with the encoder clock signal $f_E$ and the disintegrating frequency signal $f_d$ outputted from the oscillator OSC, and a high voltage switch HVS for converting a charge control signal $S_C$ outputted from the pulse width modulator PWM into a high voltage charge control signal $\phi_C$. It is to be noted that, in FIG. 10, reference symbol RM denotes a recording medium wrapped around the rotary drum DR. Further, reference symbol $O_P$ denotes an origin pulse signal which provides a timing at which the recording starting position (origin) of a main scanning line in a circumferential direction of the rotary drum DR is to be indicated.

The pulse width modulator PWM converts pixel data $D_P$ read out from the line buffer LB into a charge control signal $S_C$ having a pulse width corresponding to the value of the pixel data $D_P$. The pulse width modulator PWM is formed from, for example, a presettable counter. In particular, if the preset counter is preset with the preset data $D_P$ in response to the encoder clock signal $f_E$ and the disintegration frequency signal $f_d$ is inputted as a down clock signal to the pulse width modulator PWM, then the time until the preset down counter becomes empty after the presetting point of time of the preset down counter provides the pulse width of the charge control signal $S_C$.

FIG. 11 illustrates in diagrammatic view a principle wherein the dot size is variably controlled by pulse width modulation which is used in the continuous jet type ink jet recording apparatus shown in FIG. 10. Here, for convenience of illustration, it is shown that nine gradations are represented and the recording apparatus is designed such that the encoder clock signal $f_E$ which is an output of the shaft encoder SE has a frequency equal to one eighth the frequency of the disintegrating frequency $f_d$ outputted from the oscillator OSC and is locked in phase with the disintegrating frequency signal $f_d$. Eight ink drops in one period of the encoder clock signal $f_E$ forms one pixel. While the dot size is controlled depending upon the number of ink drops from among the eight ink drops per period of the encoder clock signal $f_E$ should be made of non-charged ink drops, the non-charged ink drop number is stored as pixel data $D_P$ in the line buffer LB. In FIG. 11, ● denotes a non-charged ink drop, which advances straightforwardly without being deflected and is recorded on the recording medium RM, and ○ denotes a charged ink drop, which is deflected and cut by the knife edge 6 and consequently does not reach the recording medium RM. Particularly, FIG. 11 illustrates the formation of a first pixel with one ink drop, a second pixel with three ink drops, and a third pixel with five ink drops.

In the conventional continuous jet type ink jet recording apparatus having the construction described above, a non-charged ink drop train to be recorded flies in the air and is decelerated by the air resistance. FIG. 12 is a diagrammatic view illustrating a behavior in which an ink drop train to for forming a pixel flies in the air. Now, it is assumed that five example ink jets which are equal in jet flying speed, disintegrating frequency fd and particle size are prepared and charge control signals $S_C$ ($\phi_C$) with which the number of non-charged ink drops per pixel is 1, 2, 3, 4 and 5 are applied simultaneously to the control electrode 4 (position "A" in FIG. 12). If the ink dot trains enter the deflecting electrode 8, then charged ink drops begin to be deflected downwardly of the jet flying axes and into the knife edge 6 by an action of the deflecting electric field ("B"). As the ink dot trains further advance in the deflecting electric field, since, in each of non-charged ink drop trains on the jet flying axes, the leading or forwardmost ink drop is acted upon by the highest air resistance, the following ink drops are gradually and successively integrated with the leading or forwardmost ink drop ("C"). With the integrated ink drop, the rate of the increasing amount of the inertial force (which increases in proportion to the third power of the particle size) becomes larger than that of the increasing amount of the air resistance (which increases in proportion to the second power of the particle size), and the degree of deceleration by the air resistance decreases. As a result, after drop integration starts, a non-charged ink drop train which has a smaller number of ink drops per pixel exhibits a larger delay, and when it passes by the knife edge 6 and arrives at the recording medium RM on the rotary drum DR, such a delay as seen in FIG. 12 is produced ("D"). By this delay, a dot of a smaller size (a dot having a lower pixel density) is recorded with a larger delay in a direction opposite to the direction of rotation (main scanning direction) of the rotary drum DR, and a positional displacement of the recorded dot corresponding to the dot size is produced.

In order to solve the problem described above, the inventor of the present invention has already proposed an ink jet recording apparatus of the continuous jet type wherein the application timing of a charge control signal $S_C$ ($\phi_C$) is delayed in response to the dot size (the delay time of a dot having a larger size is set longer) to correct the positional displacement of a recorded dot (refer to Japanese Patent Laid-Open Application No. Heisei 5-246034). While the problem mentioned above has been solved by the ink jet recording apparatus of the continuous jet type just mentioned, a new problem that the recording time is increased has arisen. In particular, with the ink jet recording apparatus of the continuous jet type mentioned, since the delay time for a larger dot size (larger number of non-charged ink drops) must be set longer, also those ink drops which are included in the delay time must be necessarily included in the number of ink drops per pixel but are nonetheless wasted. For example, while, in the case illustrated in FIG. 11, eight ink drops in one period of the encoder clock signal $f_E$ form one pixel, where the application timing of the charge control signal $S_C$ ($\phi_C$) is delayed in response to the dot size, in order to represent the same nine gradations, approximately 12 ink drops must be allocated to one period of the encoder clock signal $f_E$. As the number of ink drops per one pixel increases. The running cost is increased because of ink drops associated with the delay by wasteful ink and an increase in recording time.

Further, the inventor of the present invention has proposed another ink jet recording apparatus of the continuous jet type wherein, in order to solve the problems of an increase in running cost and an increase in recording time, correction charge corresponding to a dot size is provided to each ink drop to be recorded (hereinafter referred to as recording ink drop) and the jet flying axis of the recording ink drops is displaced in units of a pixel toward a deflection electrode side, whereby a recording dot can be positioned accurately irrespective of the dot size (refer to Japanese Patent Laid-Open Application No. Heisei 7-290704). While the two problems described above have been solved by the apparatus just described, a different problem arises in that a circuit system necessary to control the correction charge amount at a high speed is complicated and the cost for hardware increases and another different problem that some deterioration in picture quality arising from the fact that a recording ink drop has charge and the flying axis of a recording ink drop varies depending upon the dot size.

SUMMARY OF THE INVENTION

It is an object of the present invention to provide a continuous jet type ink jet recording apparatus wherein a recording dot is recorded at a predetermined dot position irrespective of the dot size without deteriorating the picture quality and without increasing the recording time.

It is another object of the present invention to provide a continuous jet type ink jet recording apparatus wherein the recording dot position can be controlled precisely.

In order to attain the objects described above, according to the present invention, a larger dot is delayed by a longer delay time to correct the positional displacement of the recording dot without increasing the recording time. Further, the recording dot position is controlled taking a preceding recording ink dot pattern or patterns into consideration.

More particularly, according to an aspect of the present invention, there is provided a continuous jet type ink jet recording apparatus, comprising disintegrating frequency signal generation means for outputting a disintegrating frequency signal, disintegrating means for disintegrating an ink jet into a train of a series of ink drops in synchronism with the disintegrating frequency signal, first storage means for storing pixel data to be recorded, delay means for delaying a dot recording clock signal by an integral number of times a period of the disintegrating frequency signal in response to the pixel data from the first storage means, second storage means for storing the pixel data read out in synchronism with the dot recording clock signal from the first storage means in a first-in first-out fashion, the pixel data stored in the second storage means being read out in synchronism with the dot recording clock signal delayed by the delay means, charging means for charging the ink drops disintegrated by the disintegrating means in response to the pixel data read out from the second storage means in synchronism with the dot recording clock signal delayed by the delay means, and deflection means for deflecting the ink drops charged by the charging means.

The continuous jet type ink jet recording apparatus is advantageous in that, since the second storage means is separate from the first storage means and the delay means are provided and ink drops disintegrated by the disintegrating means are charged in response to the pixel data read out from the second storage means in synchronism with the dot recording clock signal delayed by the delay means, an image of a high quality free from positional displacement of recorded dots can be obtained. Particularly, even when colors of a color image whose ratios of C, M and Y amounts are much different from each other are to be represented, no significant color displacement occurs.

According to another aspect of the present invention, there is provided a continuous jet type ink jet recording apparatus, comprising disintegrating frequency signal generation means for outputting a disintegrating frequency signal, disintegrating means for disintegrating an ink jet into a train of a series of ink drops in synchronism with the disintegrating frequency signal, first storage means for storing pixel data to be recorded, delay means for delaying a dot recording clock signal by an integral number of times a period of the disintegrating frequency signal in response to the pixel data from the first storage means, second storage means for storing the pixel data read out in synchronism with the dot recording clock signal from the first storage means in a first-in first-out fashion, the pixel data stored in the second storage means being read out in synchronism with the dot recording clock signal delayed by the delay means, pulse width modulation means for modulating each of the pixel data read out from the second storage means in synchronism with the dot recording clock signal delayed by the delay means into a charge control signal of a pulse width corresponding to the value of the pixel data, charging means for charging the ink drops with the charge control signal pulse width modulated by the pulse width modulation means, and deflection means for deflecting the ink drops charged by the charging means.

The continuous jet type ink jet recording apparatus is advantageous in that, since the second storage means is separate from the first storage means and the delay means are provided and a charge control signal is delayed based on pixel data to be recorded and preceding pixel data, an image of a high quality free from positional displacement of recorded dots can be obtained. Particularly, even when colors of a color image whose ratios of C, M and Y amounts are much different from each other are to be represented, no significant color displacement occurs.

Further, since the charge control signal is synchronized with the disintegrating frequency signal which controls disintegration and a delay time equal to an integral number of times the period of the disintegrating frequency signal is provided to the charge control signal, the entire system is synchronized with the disintegration. Consequently, the continuous jet type ink jet recording apparatus is advantageous also in that control in units of one ink drop can be performed accurately and recording of a high picture quality can be achieved.

Furthermore, since the second storage means is provided between the first storage means and the pulse width modulation means, the continuous jet type ink jet recording apparatus is advantageous in that, even if the delay time becomes longer than the period of the dot recording clock signal (encoder clock signal), the recording time is not increased.

Preferably, both of the continuous jet type ink jet recording apparatus are constructed such that the delay means includes a lookup table for converting, based on the pixel data from the first storage means and preceding pixel data for a plurality of pixels, the pixel data from the first storage means into pixel data which determines a delay time, and a delay circuit for delaying the dot recording clock signal in response to an output of the lookup table. Since the delay time is determined with the lookup table, which may be produced based on an experiment, the continuous jet type ink jet recording apparatus is advantageous in that the dot position can be controlled very accurately.

According to a further aspect of the present invention, there is provided a continuous jet type ink jet recording apparatus, comprising disintegrating frequency signal generation means for outputting a disintegrating frequency signal, disintegrating means for disintegrating an ink jet into a train of a series of ink drops in synchronism with the disintegrating frequency signal, storage means for storing pixel data to be recorded, read-out controlling means for delaying a dot recording clock signal by an integral number of times a frequency of the disintegrating frequency signal in response to the pixel data from the storage means and reading out the pixel data from the storage means in synchronism with the delayed dot recording clock signal, charging means for charging the ink drops disintegrated by the disintegrating means in response to the pixel data read out from the storage means in synchronism with the dot recording clock signal delayed by the read-out controlling means, and deflection means for deflecting the ink drops charged by the charging means.

According to a still further aspect of the present invention, there is provided a continuous jet type ink jet recording apparatus, comprising disintegrating frequency signal generation means for outputting a disintegrating frequency signal, disintegrating means for disintegrating an ink jet into a train of a series of ink drops in synchronism with the disintegrating frequency signal, storage means for storing pixel data to be recorded, read-out controlling means for delaying a dot recording clock signal by an integral number of times a frequency of the disintegrating frequency signal in response to the pixel data from the storage means and reading out the pixel data from the storage means in synchronism with the delayed dot recording clock signal, pulse width modulation means for modulating each of the pixel data read out from the storage means in synchronism with the dot recording clock signal delayed by the read-out controlling means into a charge control signal of a pulse width corresponding to a value of the pixel data, charging means for charging the ink drops with the charge control signal pulse width modulated by the pulse width modulation means, and deflection means for deflecting the ink drops charged by the charging means.

With the two continuous jet type ink jet recording apparatus, since the read-out controlling means having functions similar to those of the second storage means and the delay pulse generation means of the continuous jet type ink jet recording apparatus of the first and second aspects described above are used, advantages similar to those described above can be achieved.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
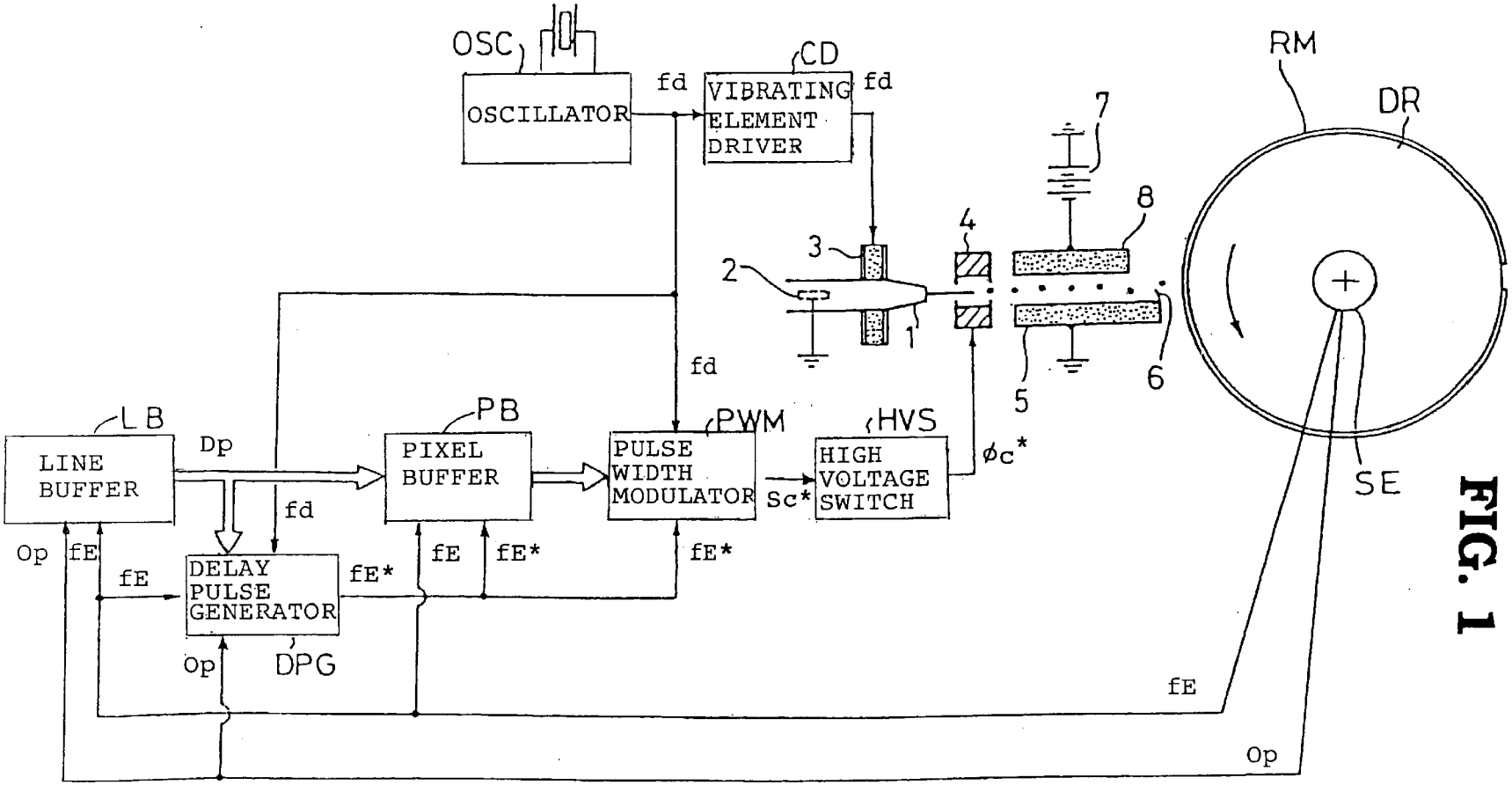
FIG. 1 is a diagrammatic view of a continuous jet type ink jet recording apparatus to which the present invention is applied.

Referring first to FIG. 1, there is shown in diagrammatic view a continuous jet type ink jet recording apparatus to which the present invention is applied. The continuous jet type ink jet recording apparatus shown is an improvement in or relating to and includes common components to those of the conventional ink jet recording apparatus of the continuous jet type described hereinabove with reference to FIG. 10. Accordingly, overlapping description of the common components is omitted here to avoid redundancy.

Figure 10:
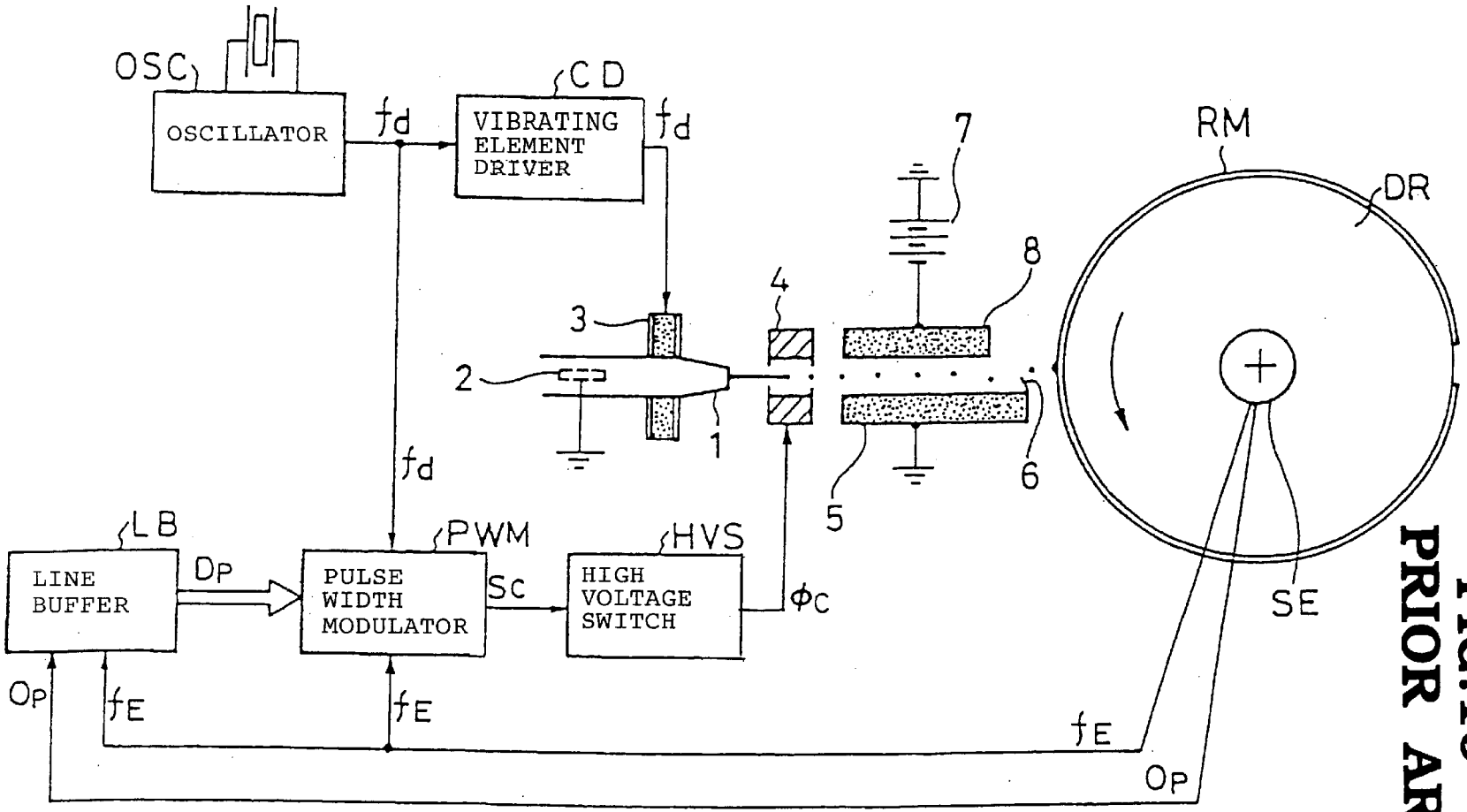
FIG. 10 PRIOR ART
FIG. 10 is a diagrammatic view showing an exemplary one of conventional continuous ink jet recording apparatus of the continuous jet type.
Figure 11:
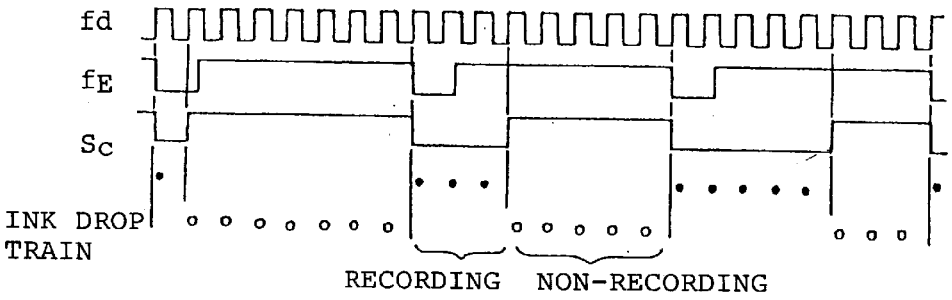
FIG. 11 PRIOR ART
FIG. 11 is a timing chart illustrating a principle wherein a recording dot diameter is variably controlled by pulse width modulation by the conventional ink jet recording apparatus of the continuous jet type shown in FIG. 10.
Figure 12:
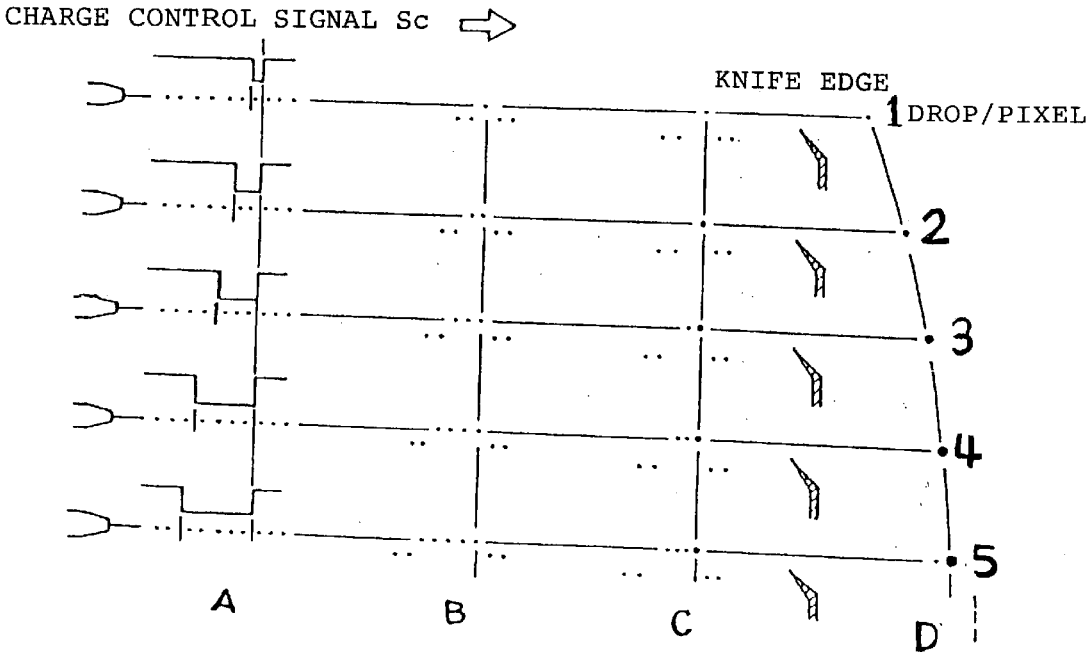
FIG. 12 PRIOR ART
FIG. 12 is a diagrammatic view illustrating that a displacement of a recording dot position corresponding to a dot size occurs with the conventional ink jet recording apparatus of the continuous jet type shown in FIG. 10.

The present continuous jet type ink jet recording apparatus is different from the conventional ink jet recording apparatus of the continuous jet type described hereinabove with reference to FIG. 10 in that it additionally includes a delay pulse generator DPG and a pixel buffer PB.

Inputted to the delay pulse generator DPG are pixel data $D_P$ outputted from the line buffer LB, an encoder clock signal $f_E$ and an origin pulse signal $O_P$ outputted from the shaft encoder SE and a disintegrating frequency signal $f_d$ outputted from the oscillator OSC.

Figure 2:
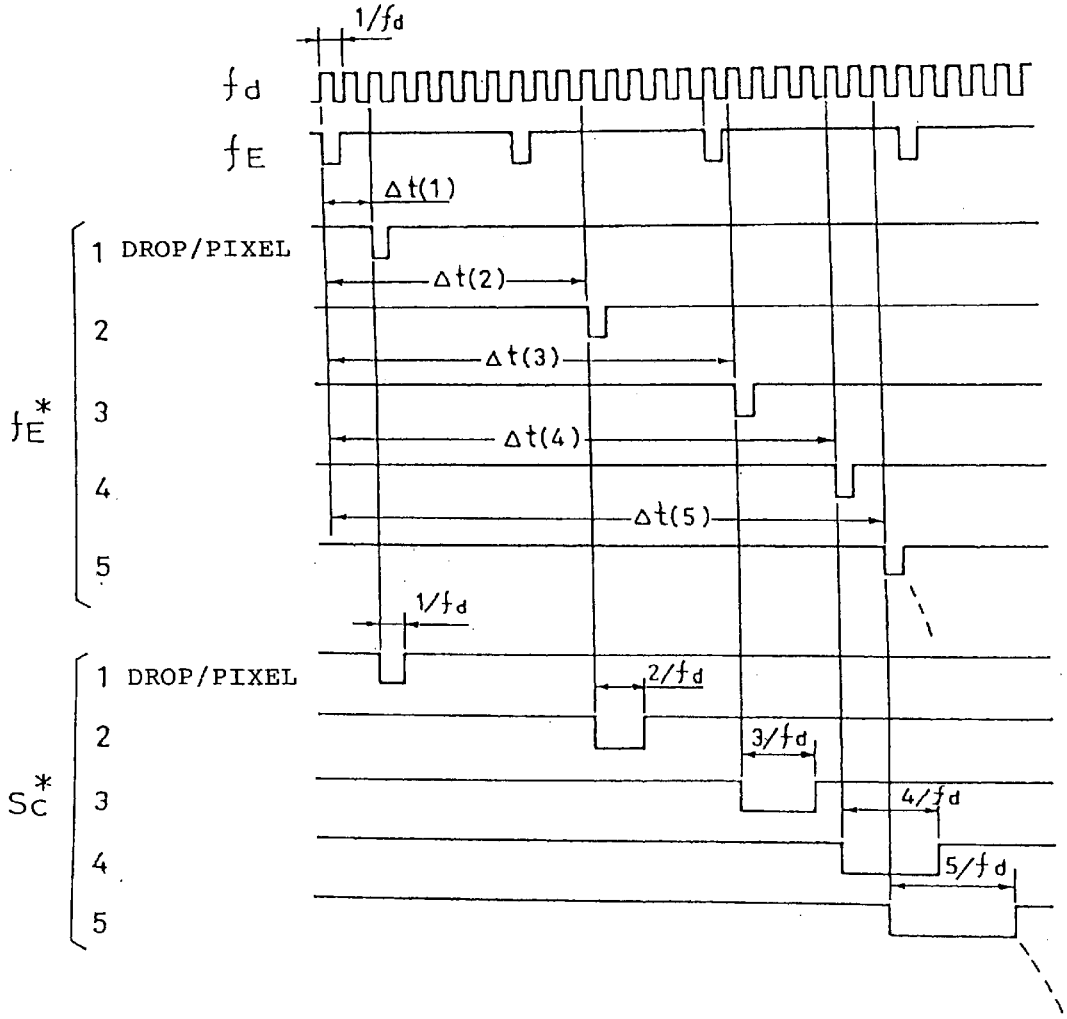
FIG. 2 is a timing chart illustrating a delay time to be generated in the continuous jet type ink jet recording apparatus shown in FIG. 1.
Figure 3:
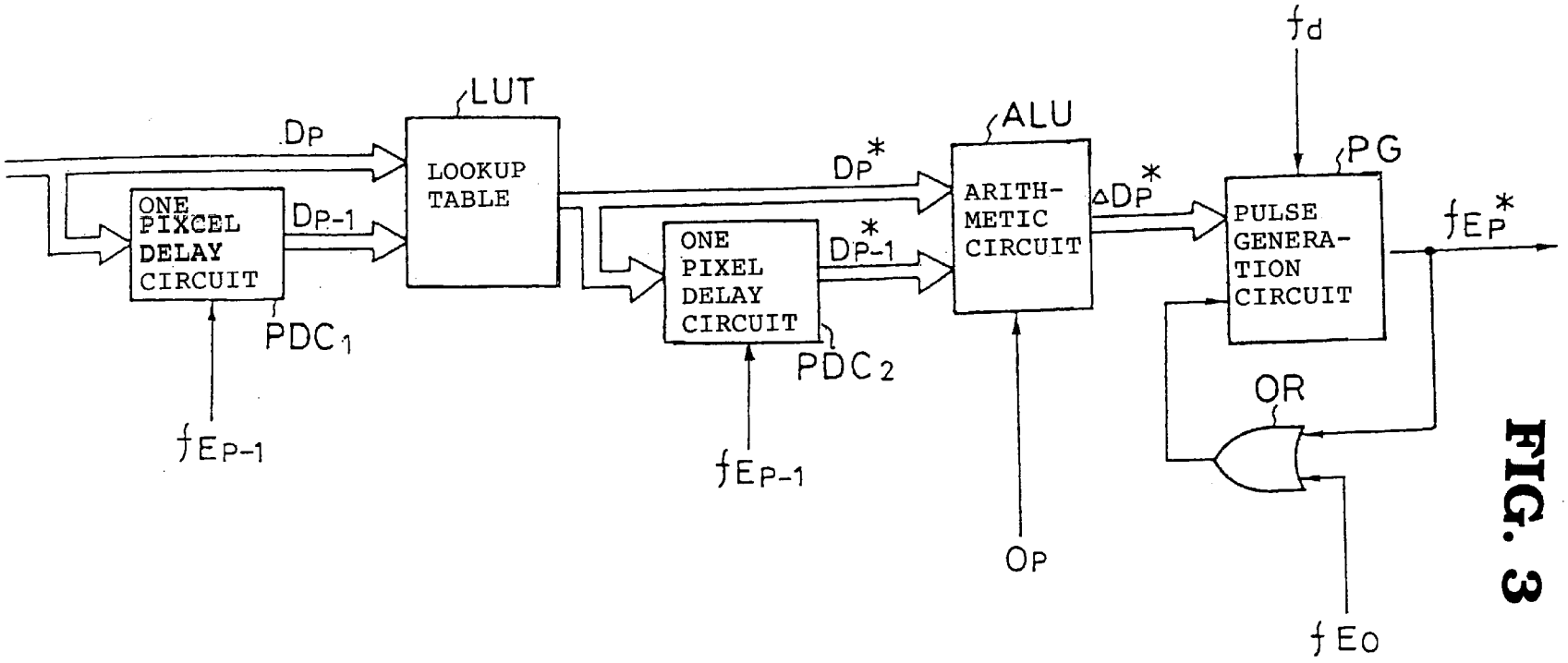
FIGS. 3 to 5 are circuit diagrams showing different forms of a delay pulse generator employed in the continuous jet type ink jet recording apparatus shown in FIG. 1.
Figure 4:
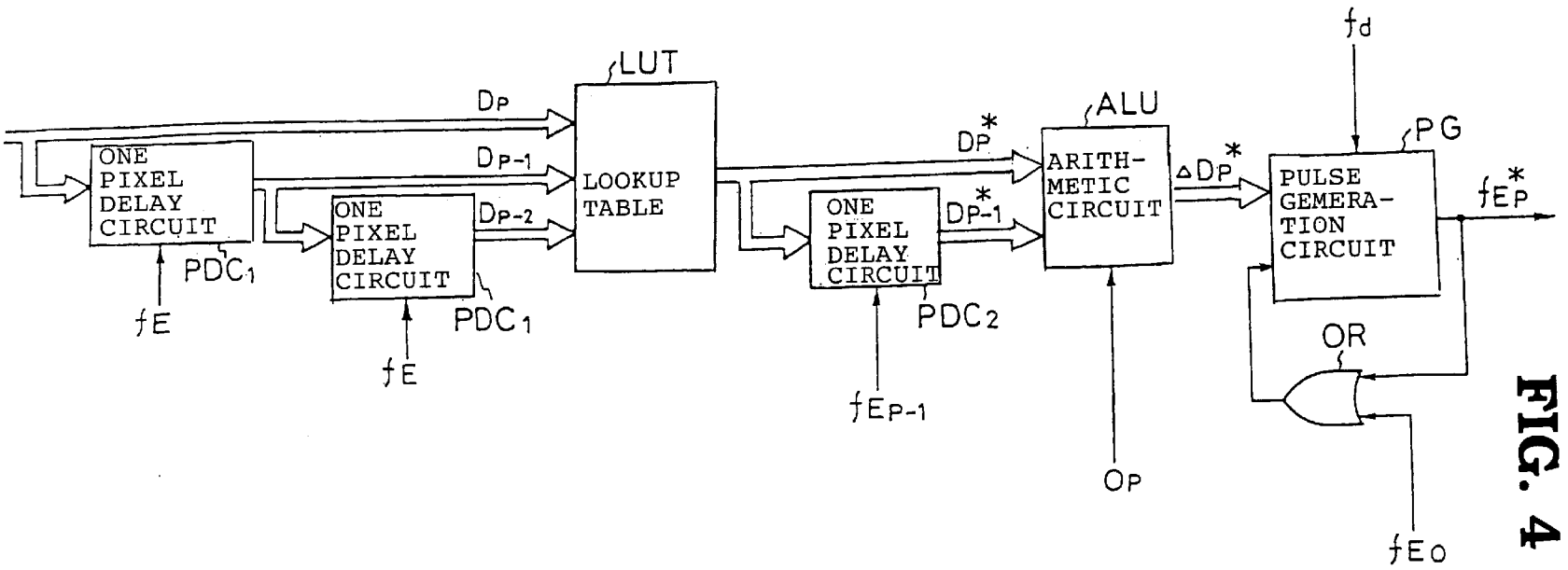
Figure 5:
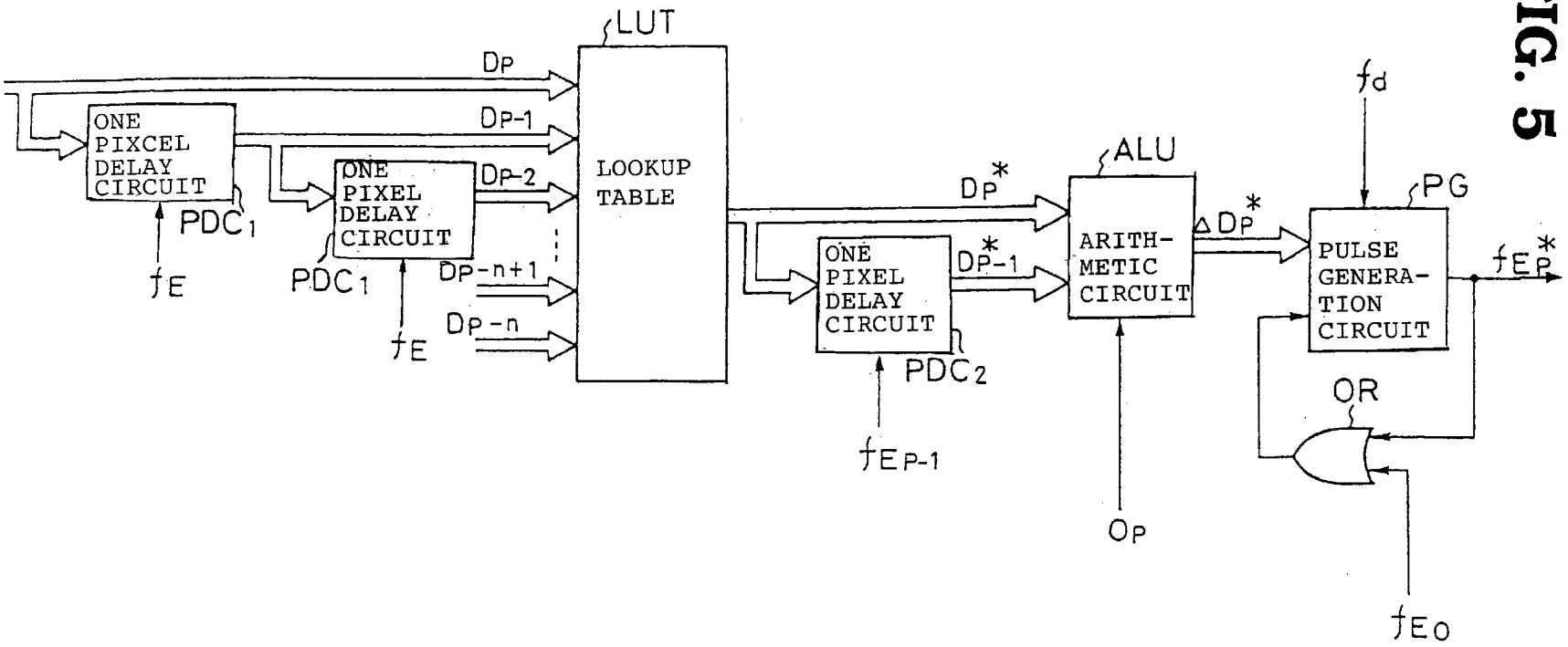

FIG. 2 diagrammatically illustrate delay times Δt(1), Δt(2), Δt(3). Δt(4) and Δt(5) to be provided to recording ink dot trains of the dot sizes of 1 dot/pixel, 2 dot/pixel, 3 dot/pixel, 4 dot/pixel and 5 dot/pixel, respectively, when there is no preceding recording ink dot train and output timings of charge control signals $S_C$* delayed then. As can be seen from FIG. 2, a delay time corresponding approximately to 3 periods (3 pixels) of the encoder clock signal $f_E$ in the maximum must be provided after the encoder clock signal $f_E$ is provided. Therefore, the encoder clock signal $f_E$ is delayed by a delay time corresponding to a value of the pixel data $D_P$ in the delay pulse generator DPG to convert it into a delayed encoder clock signal $f_E$*, and the resulting encoder clock signal $f_E$* is outputted. The encoder clock signal $f_E$* is inputted as a read-out control signal to the pixel buffer PB and is further inputted as a dot recording clock signal (which defines a falling edge of the charge control signal $S_C$*) to the pulse width modulator PWM. The delay times Δt(1), Δt(2), Δt(3), . . . of the charge control signal $S_C$* are set to an integral number $n/f_d$ (n is an integer larger than 0) of times the disintegrating frequency signal $f_d$ in response to the value of the pixel data $D_P$. Here, the value of n which represents the relationship between the pixel data $D_P$ and the delay times Δt(1), Δt(2), Δt(3), . . . is determined based on experiment data such that the delay amount $t_d$ by the air resistance is corrected so that a dot may hit at a predetermined position on the recording medium RM irrespective of the dot size. Consequently, the delay times Δt(1), Δt(2), Δt(3), . . . satisfy $\Delta t(1) \leqq \Delta t(2) \leqq \Delta t(3) \leqq \ldots$ By the way, the delay amount td by which a recording ink dot train to form a pixel is delayed by the air resistance is influenced not only by the construction of the recording ink drop train of a pixel itself but also by a preceding recording ink drop train or trains. Particularly where the number of maximum recording ink drops to form one pixel is small, that is, in a case of recording of an image having a small number of gradations, this influence must be taken into consideration sufficiently. FIGS. 3, 4 and 5 are circuit diagrams each showing an example of the delay pulse generator DPG wherein a lookup table LUT is formed taking the history (preceding recording ink dot train pattern or patterns) just mentioned into consideration.

Figure 6:
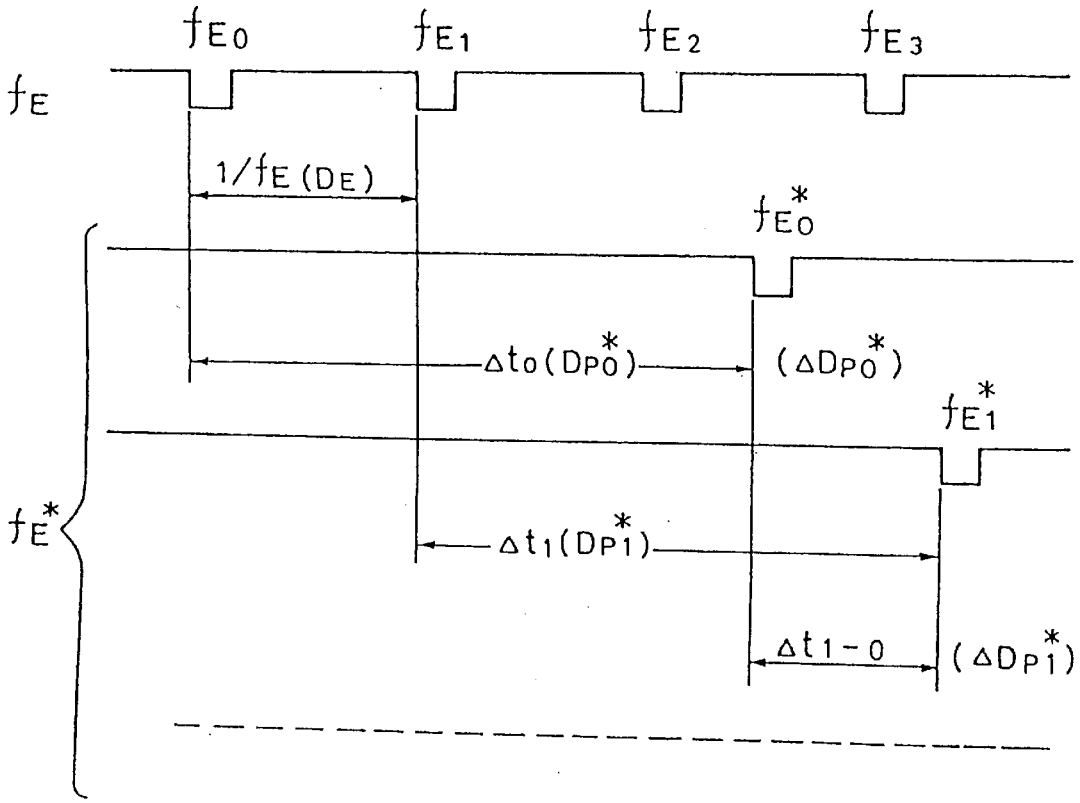
FIG. 6 is a timing chart illustrating an output timing of an encoder clock signal delayed by the continuous jet type ink jet recording apparatus shown in FIG. 1.

Referring to FIG. 3, the delay pulse generator DPG of FIG. 1 shown uses a lookup table LUT produced taking a preceding ink drop train pattern for one pixel into consideration. The delay pulse generator DPG is composed of a one pixel delay circuit $PDC_1$, a lookup table LUT, a one pixel delay circuit $PDC_2$, an arithmetic circuit ALU, a pulse generation circuit PG, and an OR circuit OR. In the delay pulse generator DPG, pixel data $D_P$ to be recorded and pixel data $D_{P-1}$ delayed by one pixel by the one pixel delay circuit $PDC_1$ are inputted to the lookup table LUT, and pixel data $D_P$* produced taking a current recording ink drop train pattern and another recording ink drop train pattern preceding by one pixel into consideration is outputted from the lookup table LUT. Table data of the lookup table LUT are experimentally determined in advance so that each dot may hit at a predetermined position irrespective of the dot size (value of the pixel data $D_P$). The pixel data $D_P$* outputted from the lookup table LUT is inputted to the arithmetic circuit ALU and inputted also to the one pixel delay circuit $PDC_2$, and pixel data $D_{P-1}$ preceding by one pixel is inputted from the one pixel delay circuit $PDC_2$ to the arithmetic circuit ALU. The arithmetic circuit ALU outputs, when an origin pulse $O_P$ is inputted thereto, the pixel data $D_P$* as it is as finite difference data $\Delta D_P$*, but thereafter calculates $\Delta D_P^* = [(D_P^* + D_E) - D_{P-1}^*]$ and outputs a result of the calculation as finite difference data $\Delta D_P$*. It is to be noted that $D_E$ is fixed data corresponding to the period $1/f_E$ of the encoder clock signal $f_E$. Consequently, as seen in FIG. 6, when an encoder clock $f_{E0}$ which is a dot recording clock at the top of a main scanning line is inputted, the pulse generation circuit PG outputs an encoder clock signal $f_{E0}$* after a delay time $\Delta t_0$ corresponding to the finite difference data $\Delta D_{P0}$* (=$D_{P0}$*), but when a next encoder clock $f_{E1}$ is inputted, the pulse generation circuit PG outputs an encoder clock signal $f_{E1}$* after a finite delay time $\Delta t_{1-0}$ corresponding to the finite difference data $\Delta D_{P1}$* (=$[(D_{P1}^* + D_E) - D_{P0}^*]$). This similarly applies also to the following encoder clocks $f_{E1}$, $f_{E2}$, $f_{E3}$, . . .

Referring now FIG. 4, the delay pulse generator DPG shown uses a lookup table LUT produced taking preceding recording ink drop train patterns for 2 pixels into consideration. The delay pulse generator DPG is composed of two stages of one pixel delay circuits $PDC_1$, a lookup table LUT, a one pixel delay circuit $PDC_2$, an arithmetic circuit ALU, a pulse generation circuit PG, and an OR circuit OR. In the delay pulse generator DPG, pixel data $D_P$ to be recorded, pixel data $D_{P-1}$ delayed by one pixel by the one pixel delay circuit $PDC_1$ at the first stage and pixel data $D_{P-2}$ delayed by two pixels by the one pixel delay circuit $PDC_1$ at the second stage are inputted to the lookup table LUT, and pixel data $D_P$* produced taking the current recording ink dot train pattern, the recording ink dot train pattern preceding by one pixel and the recording ink dot train pattern preceding by two pixels into consideration is outputted from the lookup table LUT. Table data of the lookup table LUT are determined based on an experiment as described hereinabove. Operations of the components at the following stages to the lookup table LUT are quite similar to those in the delay pulse generator DPG described hereinabove with reference to FIG. 3.

Referring now to FIG. 5, the delay pulse generator DPG shown uses a lookup table LUT produced taking preceding recording ink drop train patterns for n pixels into consideration. The delay pulse generator DPG is composed of n stages of one pixel delay circuits $PDC_1$, a lookup table LUT, a one pixel delay circuit $PDC_2$, an arithmetic circuit ALU, a pulse generation circuit PG and an OR circuit OR. In the delay pulse generator DPG, pixel data $D_P$ to be recorded, pixel data $D_{P-1}$ delayed by one pixel by the one pixel delay circuit PDCt at the first stage, . . . and pixel data $D_{P-n}$ delayed by n pixels by the one pixel delay circuit $PDC_1$ at the nth stage are inputted to the lookup table LUT, and pixel data $D_P$* produced taking the current recording input dot train pattern, the recording ink drop train pattern preceding by one pixel, . . . , and the recording ink drop train pattern preceding by n pixels into consideration is outputted from the lookup table LUT. The pixel data $D_P$* of the lookup table LUT are produced based on an experiment as described hereinabove. Operations of the components at the following stages to the lookup table LUT are quite similar to those in the delay pulse generator DPG described hereinabove with reference to FIG. 3.

As seen in FIG. 2, the delay time of the charge control signal $S_C$* increases as the pixel data $D_P$ increases, and sometimes becomes longer than the period $1/f_E$ of the encoder clock signal $f_E$. The pixel buffer PB serves as a buffer memory which temporarily stores the pixel data $D_P$ read out from the line buffer LB in response to the encoder clock signal $f_E$ within the delay time ($f_E \rightarrow f_E$*). In particular, where the maximum value of the delay time is represented by $\Delta t_{max}$, the capacity of the pixel buffer PB becomes larger than $\Delta t_{max}$*$f_E$ ($f_E$: encoder clock frequency). The pixel buffer PB is formed from a FIFO (first-in first-out) memory which receives the pixel data $D_P$ read out from the line buffer LB as input data thereto, writes the pixel data $D_P$ with the encoder clock signal $f_E$ and reads out the pixel data $D_P$ with the encoder clock signal $f_E$* outputted from the delay pulse generator DPG.

Subsequently, operation of the continuous jet type ink jet recording apparatus according to the first embodiment having the construction described above is described.

The oscillator OSC oscillates with a fixed disintegrating frequency $f_d$ and outputs a disintegrating frequency signal $f_d$.

The vibrating element driver CD amplifies the disintegrating frequency signal $f_d$ from the oscillator OSC to drive the vibrating element 3 to disintegrate an ink jet discharged from the nozzle 1 into a series of ink drop trains in synchronism with the disintegrating frequency signal $f_d$.

Meanwhile, the delay pulse generator DPG receives the pixel data $D_P$ outputted from the line buffer LB, the encoder clock signal $f_E$ and the origin pulse signal $O_P$ outputted from the shaft encoder SE and the disintegrating frequency signal $f_d$ outputted from the oscillator OSC, converts the encoder clock signal $f_E$ into an encoder clock signal $f_E$* by providing a delay time equal to an integral number of times the period $1/f_d$ of the disintegrating frequency signal $f_d$ in accordance with the value of the pixel data $D_P$ to the encoder clock signal $f_E$ and outputs the encoder clock signal $f_E$*.

The pixel buffer PB receives the pixel data $D_P$ outputted from the line buffer LB. the encoder clock signal $f_E$ outputted from the shaft encoder SE and the delayed encoder clock signal $f_E$* outputted from the delay pulse generator DPG, writes the pixel data $D_P$ with the encoder clock signal $f_E$, reads out the pixel data $D_P$ with the delayed encoder clock signal $f_E$* and outputs the read out pixel data DP to the pulse width modulator PWM.

The pulse width modulator PWM receives the pixel data $D_P$ outputted from the pixel buffer PB, the disintegrating frequency signal $f_d$ from the oscillator OSC and the encoder clock signal $f_E$* outputted from the delay pulse generator DPG and outputs a charge control signal $S_C$* which falls in synchronism with the encoder clock signal $f_E$* and has a pulse width equal to an integral number of times the period $1/f_d$ of the disintegrating frequency signal $f_d$ corresponding to the value of the pixel data $D_P$.

The high voltage switch HVS converts the charge control signal $S_C$* into a high voltage charge control signal $\phi_C$* and applies the charge control signal $\phi_C$* to the control electrode 4.

Consequently, an ink drop train discharged from the nozzle 1 and disintegrated is controlled to be charged by the control electrode 4 to form a dumpling-like recording ink drop group on the recording media in response to the recording ink drop number. In this instance, the delay amount td of the recording ink drop group produced then by the air resistance is corrected with the delay times $\Delta t(1)$, $\Delta t(2)$, $\Delta t(3)$, . . . of the charge control signal $S_C$* corresponding to the value of the pixel data $D_P$. Consequently, a dot is formed at a predetermined position on the recording medium RM irrespective of the dot size.

Figure 7:
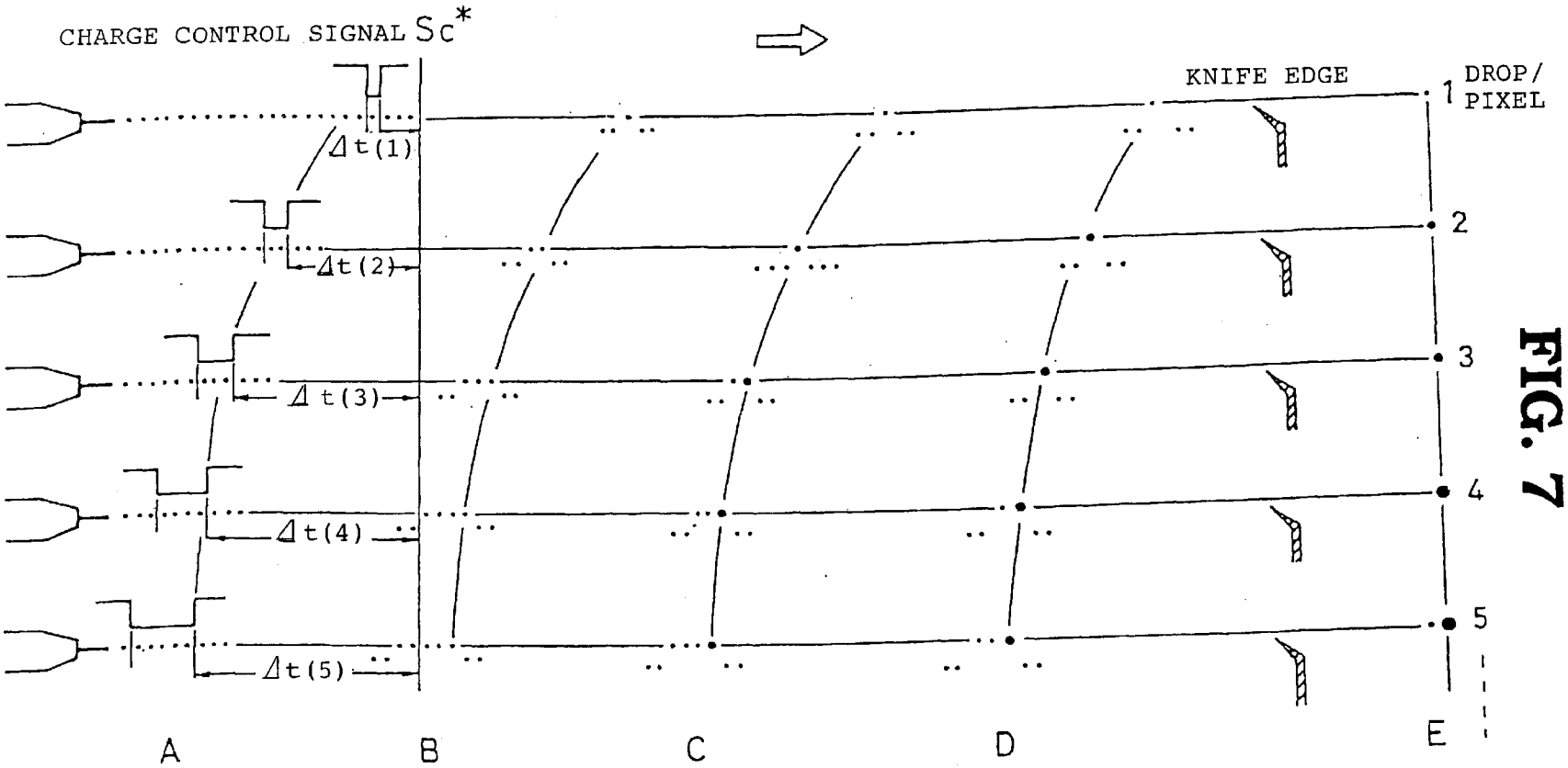
FIG. 7 is a diagrammatic view illustrating that no displacement of a recording dot position corresponding to a dot size occurs with the continuous jet type ink jet recording apparatus shown in FIG. 1.

Recording dots produced from an ink jet controlled in this manner overlap at the same point on the recording medium RM irrespective of the sizes of them. For example, it is assumed that, as shown in FIG. 7, five ink jets which are equal in jet flying speed, disintegrating frequency $f_d$ and particle size are prepared and charge control signals $S_C$ ($\phi_C$) with which the number of recording ink drops per pixel is 1, 2, 3, 4 and 5 are applied to the control electrode 4 after the delay times $\Delta t(1)$, $\Delta t(2)$, $\Delta t(3)$, $\Delta t(4)$ and $\Delta t(5)$ corresponding to the dot sizes are provided thereto, respectively, ("A"). If the ink dot trains enter the deflecting electrode 8, then non-recording ink drops begin to be deflected downwardly of the jet flying axes by an action of the deflecting electric field ("B"). As the ink dot trains further advance in the deflecting electric field, since, in each of recording ink drop trains on the jet flying axes, the leading or top recording ink drop is acted upon by the highest air resistance, the following ink drops are gradually and successively integrated with the leading or top recording ink drop ("C"). With the integrated recording ink drop group, the rate of the increasing amount of the inertial force (which increases in proportion to the third power of the particle size) becomes larger than that of the increasing amount of the air resistance (which increases in proportion to the second power of the particle size), and the degree of deceleration by the air resistance decreases. As a result, after drop integration starts, a recording ink drop train which has a smaller number of ink drops per pixel exhibits a larger delay, and when it passes by the knife edge 6 and arrives at the recording medium RM on the rotary drum DR, a delay is produced ("D"). By this delay, a dot of a smaller size (a dot having a lower pixel density) is recorded with a larger delay in a direction opposite to the direction of rotation (main scanning direction) of the rotary drum DR. However, because of the delay times $\Delta t(1)$, $\Delta t(2)$, $\Delta t(3)$, $\Delta t(4)$ and $\Delta t(5)$ given to them in advance in accordance with the dot sizes, the recording ink drop trains arrive at the same dot position on the recording medium RM ("E").

By taking a history (preceding recording ink drop train patterns or patterns) into consideration using the delay pulse generator DPG and the pixel buffer PB in this manner, an image of a higher quality having decreased positional displacements of recorded dots is obtained.

Figure 8:
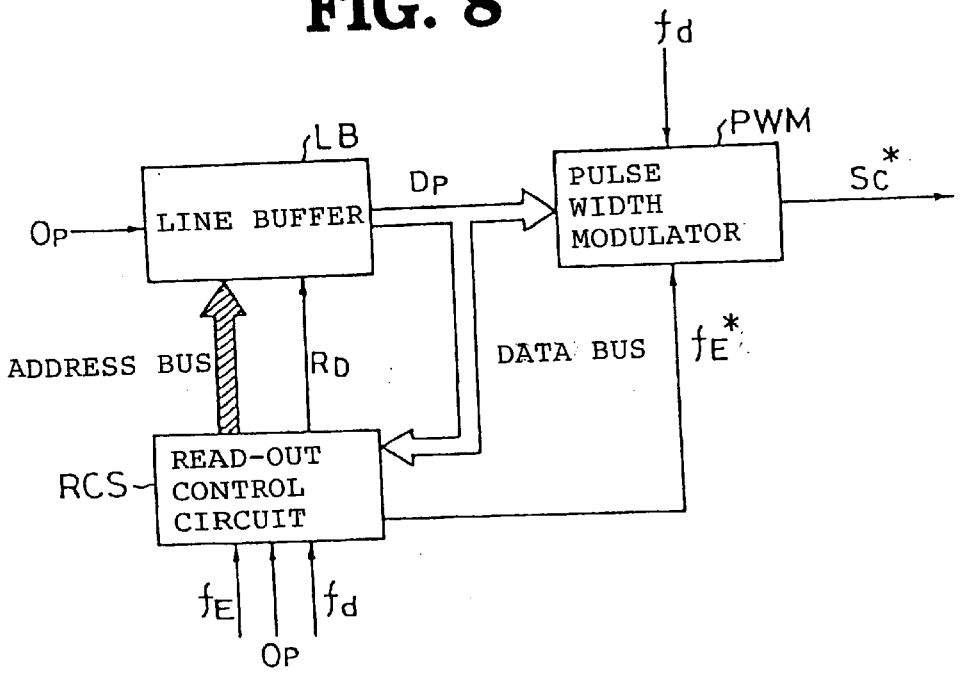
FIG. 8 is a circuit block diagram showing essential part of another continuous jet type ink jet recording apparatus to the present invention is applied.

FIG. 8 is a circuit block diagram showing part of another continuous jet type ink jet recording apparatus to which the present invention is applied. Referring to FIG. 8, also the present continuous jet type ink jet recording apparatus is an improvement in or relating to and includes common components to those of the conventional ink jet recording apparatus of the continuous jet type described hereinabove with reference to FIG. 10. Accordingly, overlapping description of the common components is omitted here to avoid redundancy.

The present continuous jet type ink jet recording apparatus is different from the conventional ink jet recording apparatus of the continuous jet type described hereinabove with reference to FIG. 10 in that it additionally includes a read-out control circuit RCS.

The read-out control circuit RCS receives an encoder clock signal $f_E$, an origin pulse signal $O_P$ and a disintegrating frequency signal $f_d$ as well as pixel data $D_P$ and outputs an address and a read-out pulse signal $R_D$ to the line buffer LB and a delayed encoder clock signal $f_E$* to the pulse width modulator PWM.

Figure 9:
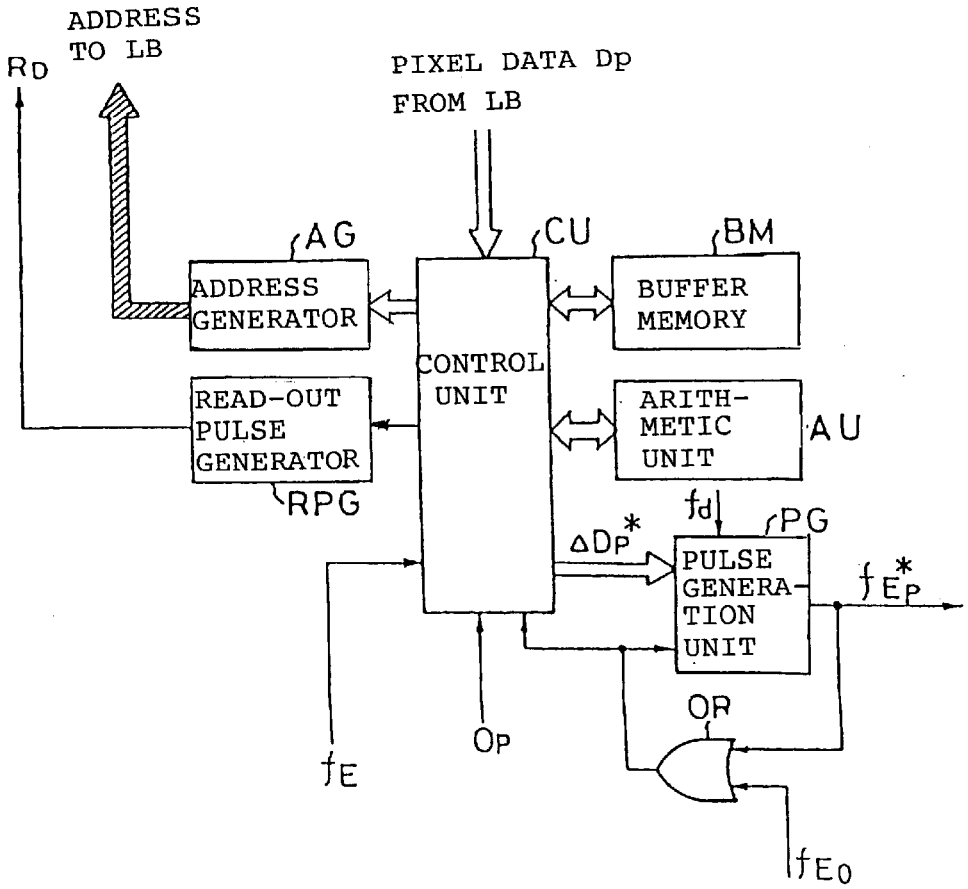
FIG. 9 is a circuit block diagram showing a detailed construction of a read-out control circuit employed in the continuous jet type ink jet recording apparatus of FIG. 8.

The read-out control circuit RCS may be constructed in such a manner as seen in FIG. 9. Referring to FIG. 9, the read-out control circuit RCS shown is composed of an address generator AG for generating an address to the line buffer LB, a read-out pulse generator RPG for generating a read-out pulse signal $R_D$ to the line buffer LB, a control unit CU for controlling operation of the entire read-out control circuit RCS, a buffer memory BM for storing pixel data $D_P$ read out from the line buffer LB and a lookup table, an arithmetic unit AU for calculating a finite difference between delay times, and a pulse generation circuit PG for generating an encoder clock signal $f_E$* delayed by a determined delay time. It is to be noted that the read-out control circuit RCS may be formed as a one chip device from an MPU having such functions as described above.

Subsequently, operation of the read-out control circuit RCS of the continuous jet type ink jet recording apparatus according to the second embodiment having such a construction as described above is described.

Here, operation with a delay time $\Delta t_i$ from an encoder clock $f_{Ei}$ is determined based on pixel data $D_{Pl}$ of a self or current pixel and pixel data $D_{Pi-1}$ of a preceding pixel is described with reference to the timing chart of FIG. 6. It is to be noted that, in the line buffer LB, pixel data $D_{P0}$, $D_{P1}$, $D_{P2}$, . . . for one line are stored in order in addresses $A_0$, $A_1$, $A_2$, . . . beginning with the top address of $A_0$, respectively.

(1) In the read-out control circuit RCS, when a first encoder clock $f_{E0}$ is received, the control unit CU controls the address generator AG to output the address $A_0$ to the line buffer LB and simultaneously controls the read-out pulse generator RPG to output a read-out pulse $R_D$ to the line buffer LB. When pixel data $D_{P0}$ is read out onto the data bus from the line buffer LB, the control unit CU fetches the pixel data $D_{P0}$ and stores it into the buffer memory BM.

(2) Then, the control unit CU refers to the lookup table stored in the buffer memory BM using the pixel data $D_{P0}$ and pixel data $D_{P-1}$ (=0: there is no preceding recording ink dot train) as an address to obtain pixel data $D_{P0}$* which determines the delay time $\Delta t_0$. It is to be noted that data of the lookup table are determined based on an experiment and written in advance.

(3) Thereafter, the control unit CU outputs, since it is the time immediately after reception of the origin pulse signal $O_P$, the obtained pixel data $D_{P0}$* as it is as finite difference data $\Delta P_0$* which determines the delay time $\Delta t_0$ to the pulse generation circuit PG. The pulse generation circuit PG is formed from a preset decrementing counter and presets the finite difference data $\Delta D_P$*, and then starts an operation of decrementing the finite difference data $\Delta D_{P0}$* with the disintegrating frequency signal $f_d$.

(4) Then, when the encoder clock signal $f_{E1}$ is received, the control unit CU controls the address generator AG to output the address $A_1$ to the line buffer LB and simultaneously controls the read-out pulse generator RPG to output a read-out pulse signal RD to the line buffer LB. When pixel data $D_{P1}$ is read out onto the data bus from the line buffer LB, the control unit CU fetches and stores the pixel data $D_{P1}$ into the buffer memory BM.

(5) Thereafter, the control unit CU refers to the lookup table stored in the buffer memory BM using the pixel data $D_{P1}$ and the pixel data $D_{P0}$ as an address and acquires pixel data $D_{P1}$* which determines the delay time $\Delta t_1$. At this point of time, the pulse generation circuit PG remains in an operating state (remains subtracting the finite difference data $\Delta D_{P0}$*) and cannot receive the next finite difference data $\Delta D_{P1}$*. Therefore, the control unit CU controls the arithmetic unit AU to calculate finite difference data $\Delta D_{P1}$*= $[(D_{P1}^*+D_E)-D_{P0}^*]$, which determines the finite difference delay time $\Delta t_{1-0}$ from the encoder clock signal $f_{E0}$* to the encoder clock signal $f_{E1}$*, in advance and stores the calculated data into the buffer memory BM.

(6) Then, when the encoder clock signal $f_{E2}$ is received, the control unit CU controls the address generator AG to output the address $A_2$ to the line buffer LB and simultaneously controls the read-out pulse generator RPG to output a read-out pulse signal $R_D$ to the line buffer LB. When pixel data $D_{P2}$ is read out onto the data bus from the line buffer LB, the control unit CU fetches and stores the pixel data $D_{P2}$ into the buffer memory BM.

(7) Thereafter, the control unit CU refers to the lookup datable stored in the buffer memory BM using the pixel data $D_{P2}$ and the pixel data $D_{P1}$ as an address and acquires pixel data $D_{P2}$* which determines the delay time $\Delta t_2$. At this point of time, the pulse generation circuit PG remains in an operating state (remains subtracting the finite difference data $\Delta D_{P0}$*) and cannot accept the second next finite difference data $\Delta D_{P2}$*. Therefore, the control unit CU controls the arithmetic unit AU to calculate finite difference data $\Delta D_{P2}$*= $[(D_{P2}^*+D_E)-D_{P1}]$, which determines the finite difference delay time $\Delta t_{2-1}$ from the encoder clock signal $f_{E1}$* to the encoder clock signal $f_{E2}$*, in advance and stores the calculated data into the buffer memory BM.

(8) When the count value of the pulse generation circuit PG becomes equal to "0", the pulse generation circuit PG outputs the delayed encoder clock signal $f_{E0}$*. When the encoder clock signal $f_{E0}$* is received, the control unit CU controls the address generator AG to output the address $A_0$ to the line buffer LB and simultaneously controls the read-out pulse generator RPG to output a read-out pulse signal $R_D$ to the line buffer LB. When the pixel data $D_{P0}$ is read out onto the data bus from the line buffer LB, the pulse width modulator PWM fetches the pixel data $D_{P0}$ in response to the delayed encoder clock signal $f_{E0}$* and pulse width modulates the pixel data $D_{P0}$.

(9) Then, the control unit CU reads out the next finite difference data $\Delta D_{P1}$* calculated already from the buffer memory BM and outputs the finite difference data $\Delta D_{P1}$* to the pulse generation circuit PG. The pulse generation circuit PG presets the finite difference data $\Delta D_{P1}$* thereon and starts an operation of decrementing the finite difference data $\Delta D_{P1}$* with the disintegrating frequency signal $f_d$.

(10) Thereafter, the operations (4) to (9) are repeated to successively produce delayed encoder clocks $f_{E1}$*, $f_{E2}$*, $f_{E3}$*, . . .

While, in the embodiments described above, a continuous jet type ink jet recording apparatus of the Hertz type wherein a charged ink drop is deflected and removed while a non-charged ink drop is recorded, it is obvious that the present invention can be applied similarly to a continuous jet type ink jet recording apparatus of the binary value deflecting Sweet type wherein a non-charged ink drop is removed while recording is performed with a charged ink drop charged to a fixed level.

Further, while a continuous jet type ink jet recording apparatus which can represent gradations by pulse width modulation of a charge control signal is described, the present invention can be applied similarly to another continuous jet type ink jet recording apparatus of the binary value recording type wherein one pixel is formed from a single ink drop. In this instance, it is a matter of course that pixel data is not pixel density data but is pixel binary value data representative of on/off of a pixel. Further, the delay time in this instance is variably adjusted in response to a preceding pixel pattern or patterns (preceding recording ink drop train pattern or patterns) using the delay pulse generator shown in FIGS. 4 or 5.

Having now fully described the invention, it will be apparent to one of ordinary skill in the art that many changes and modifications can be made thereto without departing from the spirit and scope of the invention as set forth herein.

What is claimed is:

1. A continuous jet type ink jet recording apparatus, comprising:

disintegrating frequency signal generation means for outputting a disintegrating frequency signal;

disintegrating means for disintegrating an ink jet into a train of a series of ink drops in synchronism with the disintegrating frequency signal;

first storage means for storing pixel data to be recorded on a recording medium;

delay means for delaying a dot recording clock signal by an integral number of times a period of the disintegrating frequency signal in response to the pixel data from said first storage means, said delay means including means for converting, based on the pixel data from said first storage means and pixel data for at least one preceding pixel, the pixel data from said first storage means into pixel data which determines a delay time, and a delay circuit for delaying the dot recording clock signal in response to an output of said means for converting;

second storage means for storing the pixel data read out in synchronism with the dot recording clock signal from said first storage means in a first-in first-out fashion, the pixel data stored in said second storage means being read out in synchronism with the dot recording clock signal delayed by said delay means;

charging means for charging the ink drops disintegrated by said disintegrating means in response to the pixel data read out from said second storage means in synchronism with the dot recording clock signal delayed by said delay means; and deflection means for deflecting the ink drops charged by said charging means.

2. A continuous jet type ink jet recording apparatus as claimed in claim 1 wherein said means for converting includes a lookup table for converting, based on the pixel data from said first storage means and preceding pixel data for at least one preceding pixels, the pixel data from said first storage means into pixel data which determines a delay time, and a delay circuit for delaying the dot recording clock signal in response to an output of said lookup table.

3. A continuous jet type ink jet recording apparatus as claimed in claim 1 wherein said second storage means comprises a FIFO memory which receives the dot recording clock signal or a signal synchronized with the dot recording clock signal as a write control signal and receives an output signal of said delay means or a signal synchronized with the output signal of said delay means as a read-out control signal.

4. A continuous jet type ink jet recording apparatus, comprising:

disintegrating frequency signal generation means for outputting a disintegrating frequency signal;

disintegrating means for disintegrating an ink jet into a train of a series of ink drops in synchronism with the disintegrating frequency signal:

first storage means for storing pixel data to be recorded on a recording medium;

delay means for delaying a dot recording clock signal by an integral number of times a period of the disintegrating frequency signal in response to the pixel data from said first storage means, said delay means including means for converting, based on the pixel data from said first storage means and pixel data for at least one preceding pixel, the pixel data from said first storage means into pixel data which determines a delay time, and a delay circuit for delaying the dot recording clock signal in response to an output of said means for converting;

second storage means for storing the pixel data read out in synchronism with the dot recording clock signal from said first storage means in a first-in first-out fashion, the pixel data stored in said second storage means being read out in synchronism with the dot recording clock signal delayed by said delay means;

pulse width modulation means for modulating each of the pixel data read out from said second storage means in synchronism with the dot recording clock signal delayed by said delay means into a charge control signal of a pulse width corresponding to the value of the pixel data;

charging means for charging the ink drops with the charge control signal pulse width modulated by said pulse width modulation means; and deflection means for deflecting the ink drops charged by said charging means.

5. A continuous jet type ink jet recording apparatus as claimed in claim 4 wherein said means for converting includes a lookup table for converting, based on the pixel data from said first storage means and preceding pixel data for at least one preceding pixels, the pixel data from said first storage means into pixel data which determines a delay time, and a delay circuit for delaying the dot recording clock signal in response to an output of said lookup table.

6. A continuous jet type ink jet recording apparatus as claimed in claim 4 wherein said second storage means comprises a FIFO memory which receives the dot recording clock signal or a signal synchronized with the dot recording clock signal as a write control signal and receives an output signal of said delay means or a signal synchronized with the output signal of said delay means as a read-out control signal.

7. A continuous jet type ink jet recording apparatus, comprising:

disintegrating frequency signal generation means for outputting a disintegrating frequency signal:

disintegrating means for disintegrating an ink jet into a train of a series of ink drops in synchronism with the disintegrating frequency signal;

storage means for storing pixel data for a plurality of successive pixels to be recorded on a recording medium;

read-out controlling means for delaying a dot recording clock signal by an integral number of times a frequency of the disintegrating frequency signal as a function of pixel data for a first pixel and for at least one preceding pixel from said storage means and reading out the pixel data from said storage means in synchronism with the delayed dot recording clock signal;

charging means for charging the ink drops disintegrated by said disintegrating means in response to the pixel data read out from said storage means in synchronism with the dot recording clock signal delayed by said, read-out controlling means; and deflection means for deflecting the ink drops charged by said charging means.

8. A continuous jet type ink jet recording apparatus as claimed in claim 7, wherein said read-out controlling means comprises address generation means for generating an address for said storage means, read-out pulse generation means for generating a read-out pulse signal to said storage means, buffer means for storing pixel data read out from said storage means, calculation means for calculating a finite difference between delay times, and delay pulse generation means for generating the dot recording clock signal delayed for each finite difference between delay times calculated by said calculation means.

9. A continuous jet type ink jet recording apparatus, comprising:

disintegrating frequency signal generation means for outputting a disintegrating frequency signal;

disintegrating means for disintegrating an ink jet into a train of a series of ink drops in synchronism with the disintegrating frequency signal;

storage means for storing pixel data for a plurality of successive pixels to be recorded on a recording medium;

read-out controlling means for delaying a dot recording clock signal by an integral number of times a frequency of the disintegrating frequency signal as a function of pixel data for a first pixel and for at least one preceding pixel from said storage means and reading out the pixel data from said storage means in synchronism with the delayed dot recording clock signal:

pulse width modulation means for modulating each of the pixel data read out from said storage means in synchronism with the dot recording clock signal delayed by said read-out controlling means into a charge control signal of a pulse width corresponding to a value of the pixel data;

charging means for charging the ink drops with the charge control signal pulse width modulated by said pulse width modulation means; and deflection means for deflecting the ink drops charged by said charging means.

10. A continuous jet type ink jet recording apparatus as claimed in claim 9, wherein said read-out controlling means comprises address generation means for generating an address for said storage means, read-out pulse generation means for generating a read-out pulse signal to said storage means, buffer means for storing pixel data read out from said storage means, calculation means for calculating a finite difference between delay times, and delay pulse generation means for generating the dot recording clock signal delayed for each finite difference between delay times calculated by said calculation means.

* * * * *